US006203452B1

(12) United States Patent
Kelman et al.

(10) Patent No.: US 6,203,452 B1
(45) Date of Patent: Mar. 20, 2001

(54) GOLF BALL TEE-UP DEVICE

(76) Inventors: Charles D. Kelman, 631 S. Ocean Blvd., Boca Raton, FL (US) 33432; Robert S. Dorfman, 5601 NW. 2nd Ave., Suite 120, Boca Raton, FL (US) 33487-3849

( * ) Notice: Subject to any disclaimer, the term of this patent is extended or adjusted under 35 U.S.C. 154(b) by 0 days.

(21) Appl. No.: 09/451,784

(22) Filed: Dec. 1, 1999

(51) Int. Cl.[7] ..... A63B 57/00
(52) U.S. Cl. ..... 473/386
(58) Field of Search ..... 473/386, 132, 473/137; 294/19.2, 19.1

(56) References Cited

U.S. PATENT DOCUMENTS

| | | | | |
|---|---|---|---|---|
| 2,901,146 | * | 8/1959 | Powell, Jr. et al. | 473/386 |
| 4,360,199 | * | 11/1982 | Jackson | 473/386 |
| 5,499,813 | * | 3/1996 | Black | 473/386 |
| 5,624,333 | * | 4/1997 | Dayton | 473/386 |
| 6,053,821 | * | 4/2000 | Palmer | 473/386 |

* cited by examiner

*Primary Examiner*—Steven Wong

(74) *Attorney, Agent, or Firm*—Robert M. Dowey, P.A.

(57) ABSTRACT

A device for systematically placing a golf ball on a tee and driving the tee into the ground, to thereby tee-up the golf ball, includes a base with a hopper for holding a supply of tees, and an elongate housing movably fitted to the base. A ball silo within the housing holds a supply of golf balls in a vertical array along a longitudinal axis. While maintaining the base on the ground and applying a downward force on a handle at the top of the housing, the housing is moved relative to the base through a selected range of downward movement, defining a stroke. The stroke movement drives a feed assembly and a pick-up arm to deliver a tee into a loaded position in axial alignment with the longitudinal axis below a lowermost ball in the silo. Thereafter, a timing assembly releases the lowermost ball onto the tee and continued downward movement through the stroke exerts pressure on the top of the ball, thereby driving the tee into the ground. An adjustment member on the housing enables selective adjustment of the stroke distance to thereby control the depth to which the tee is driven into the ground, and thus the height at which the ball is supported above the ground surface. Upon release of the downward force on the handle, springs urge the housing upwardly through a return movement to the first position as the timing assembly drops the remaining balls in the silo one lowered position so that a next successive lowermost ball is held in position to be dropped on a tee during the next downward stroke.

18 Claims, 5 Drawing Sheets

GOLF BALL TEE-UP DEVICE

BACKGROUND OF THE INVENTION

1. Field of the Invention

The present invention is directed to a golf ball tee-up device and, more particularly, to a device for systematically placing a golf ball on a tee and driving the tee, with the golf ball supported thereon, into the ground in accordance with a selected ball height above the ground, to thereby tee-up a golf ball for subsequent hitting with a golf club.

2. Discussion of the Related Art

When making the first golf shot (i.e. "teeing off") at each hole on a golf course, it is permissible to use a tee in order to advantageously raise and position the ball above the turf so that the face of the golf club strikes the ball cleanly and uninterrupted, thereby adding distance to the first shot. To place the golf ball on the tee (i.e. "tee up"), the ball and tee are grasped in one hand and, while bending, the pointed end of the tee is inserted into the ground as the ball is held on the tee. Most golfers tee up by holding the golf ball in the palm of their hand with the top of the tee held against the ball and with the tee extending out between the fingers. The palm can then be used to force the ball downwardly against the tee so that the tee is driven into the ground to the desired depth, thereby positioning the ball at a select height above the ground surface. The height at which the ball is positioned is largely dependent on the type of club being used, as well as personal preference of the golfer. When the ball is hit off of the tee, the bottom of the club face usually strikes the top of the tee, causing the tee to be removed from the ground. In many instances, the tee will fly a considerable distance, sometimes more than five feet, from the initial tee-up location.

During a game of golf played on a golf course, wherein a tee is usually used just once at each hole, the physical motions involved in teeing up the golf ball are of no significant consequence to the golfer's performance. Although, golfers suffering from back related ailments may find the pain and discomfort of bending over to tee-up the ball at each hole to be somewhat disruptive to their game, especially when having to bend just prior to swinging the golf club to tee off. More significantly, it is during practice that the repetitious physical actions of bending down to retrieve a tee and golf ball and then almost immediately bending down again to tee-up the ball prior to each shot can take its toll on even a well conditioned, physically healthy golfer. When practicing, at a driving range, most golfers will devote the entire practice session to improving either their "long game" or "short game," during which the average golfer may hit between 50 to 200 balls. Generally, the "long game" involves use of woods, including the driver, as well as low number irons or long irons (i.e., the two iron through five iron). When practicing one's long game, and particularly when hitting with the driver, a golfer will tee up many, if not all, of the balls being hit during the practice session. After hitting each ball, the golfer must bend to retrieve the tee and a new ball for the next shot. Inevitably, the repetitious bending motions between each shot begin to induce back pain and/or muscle fatigue which has a negative impact on a golfer's swing, resulting in a diminishing performance in the practiced session. Even in the absence of any back related disorders, many golfers find the constant bending to be annoying and disruptive to their rhythm, particularly when hitting a large number of balls, in close succession, during practice. As inconvenient as this is to the practicing golfer, to the professional, giving lessons all day, it is disastrous, as he tees up every ball for every pupil.

Accordingly, there remains a need for a device, in the golf industry, which is specifically structured to tee-up a golf ball without requiring the golfer to constantly bend down between each shot to pick up a new ball and a tee from the ground.

SUMMARY OF THE INVENTION

The present invention is directed to a device for systematically placing a golf ball on a tee and driving the tee into the ground, with the golf ball supported thereon, to thereby tee-up the golf ball for making a golf shot. The device includes a base with a hopper for holding a supply of tees, and an elongate housing movably fitted to the base. A ball silo within the housing holds a supply of golf balls in a vertical array along a longitudinal axis. The housing is movable against compression springs through a selected range of downward movement, defining a stroke, by applying a downward force on a handle fitted to the top end of the housing. Specifically, the housing is movable relative to the base and the ground from a relaxed first position at the top of the stroke to a stopped second position at the bottom of the stroke.

During a first thrust increment of the downward stroke, a feed assembly delivers a tee into position for transfer to a pick-up arm. The pick-up arm simultaneously moves a previously delivered tee (from the previous stroke) into a loaded position in axial alignment with the longitudinal axis below a lowermost ball in the silo. Once the tee is in the loaded position, a timing assembly releases the lowermost ball onto the tee during continued movement through the downward stroke. With the ball seated on the tee, the continued movement of the housing to the bottom of the stroke results in a downward force exerted on the ball, thereby driving the tee into the ground. The depth to which the tee is driven into the ground, and thus the height at which the ball is supported above the ground surface, is controlled by selecting the range of downward movement of the housing (i.e., the distance of the stroke of the housing between the first position and the second position). This is done by rotating an adjustment collar about the housing and stopping the collar at one of three adjustment positions.

Upon reaching the bottom of the stroke, at the second position, a downward force is released from the handle at the top of the housing, allowing the compression springs to urge the housing back to the first position, thereby completing a tee-up cycle. During the return movement of the housing to the first position (i.e., the top of the stroke), the timing assembly drops the remaining balls in the silo one lowered ball position, so that a next successive lowermost ball in the silo is in position to be dropped on a tee during the next stroke.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
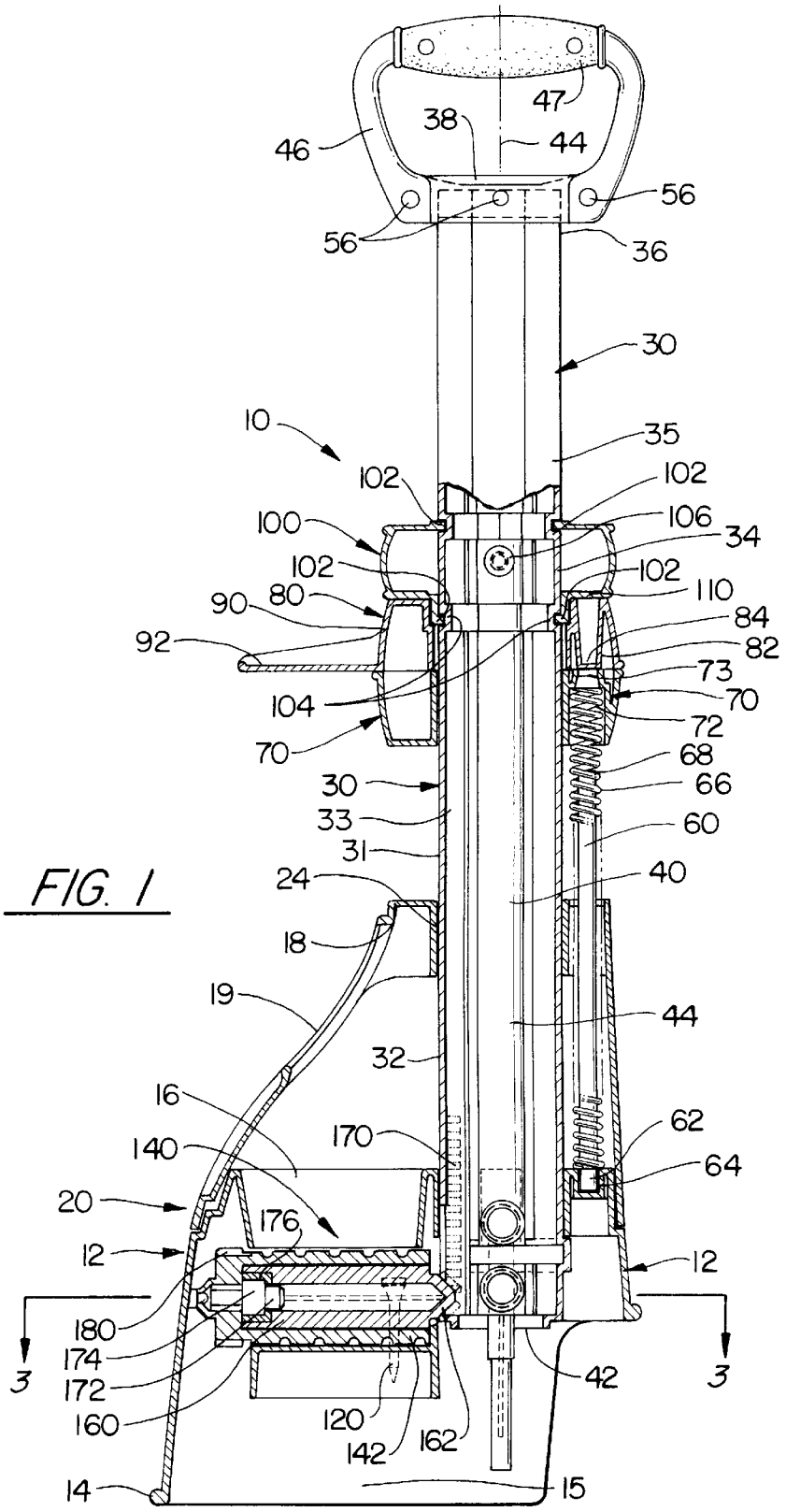
FIG. 1 is a side elevational view, in partial section, illustrating the golf ball tee-up device of the present invention.
Figure 2:
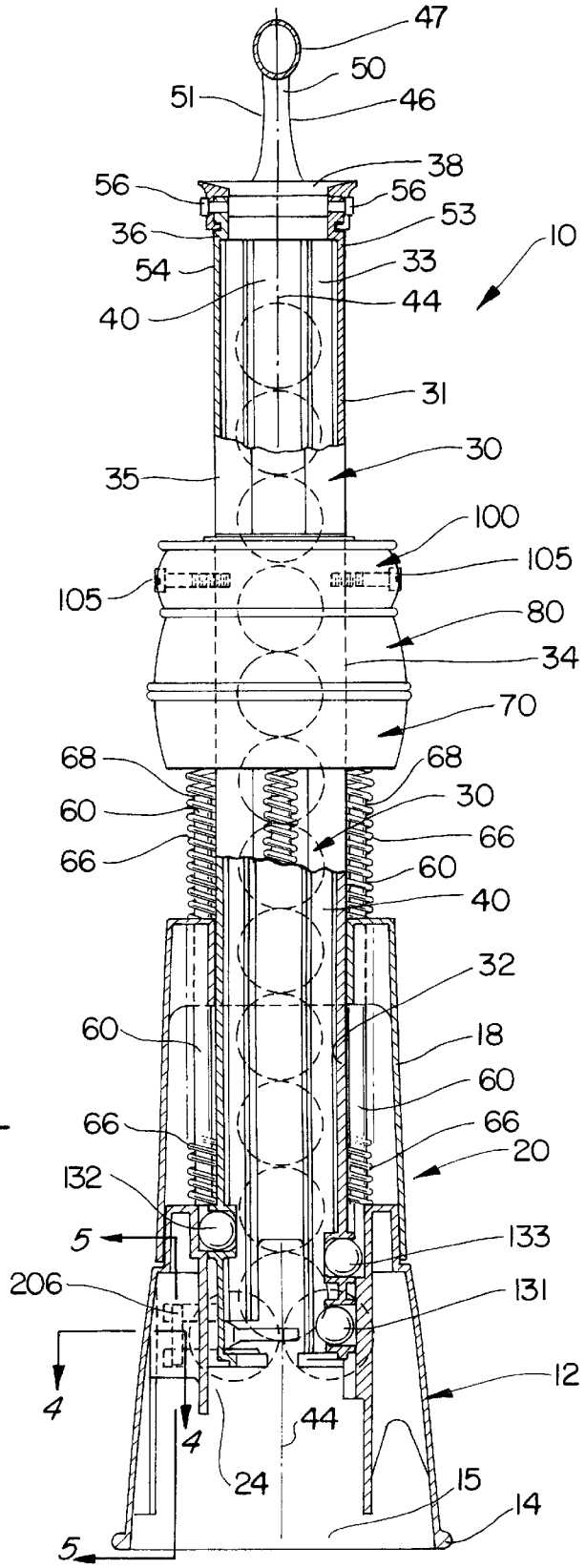
FIG. 2 is a front elevational view, in partial section, illustrating the golf ball tee-up device.

Referring initially to FIGS. 1 and 2, the golf ball tee-up device is shown and generally indicated as 10. The device 10 includes a base 12 having an inner wall surface 13, and a bottom rim 14 defining a ground engaging portion surrounding an open area 15. The base 12 further includes a hopper 16 for holding a supply of golf tees therein and in direct communication with a feed roller assembly, as described more fully hereinafter. A cover 18 may be integrally formed with the base 12 or fashioned as a separate piece for attachment to the base 12 (e.g., by snap-fit engagement, screw fasteners, gluing or other means) to thereby complete a lower assembly 20 of the device. The cover 18 includes an opening 19 to facilitate placement of tees into the hopper 16.

The combined structure 20 of the cover 18 and base 12 further provide a vertical channel 24 for receipt of a lower end zone 32 of an elongate body or housing 30. When fitted to the lower assembly 20, as seen in FIGS. 1 and 2, the elongate housing 30 extends upwardly so that a central zone 34 and top end 36 of the housing are spaced above the lower assembly 20. An open mouth 38 at the top end 36 communicates with a hollow interior elongate chamber, defining a ball silo 40. Balls A, B, C, D, etc. deposited through the open mouth 38 are received within the silo 40 and are maintained in a stacked, vertical array along a longitudinal axis 44 extending from a lower open distal end 42 of the housing 30 through the open mouth 38 at the top. In a preferred embodiment, the longitudinal wall structure 31 of the housing 30 is multi-sided on both the inner facing side 33 (within the silo) and the exterior 35. A handle 46 is fitted to the top end 36 of the housing and includes a grip portion 47 which, in a preferred embodiment, is positioned directly above the longitudinal axis 44. This facilitates exertion of a downward force along the longitudinal axis for moving the housing 30 downwardly, towards the lower assembly 20 (i.e., the base 12), during a downward stroke, as described hereinafter. For purposes of manufacture, the elongate housing 30 and handle 46 may both be constructed as two opposing halves (i.e., a left half and a right half) which are generally symmetrical. The two halves 50, 51 of the handle 46 are attached to the top end of the assembled halves 53, 54 of the housing 30, as best seen in FIG. 2, and are secured with the use of conventional fasteners 56, such as stainless steel screws or bolts.

Reciprocating downward and upward movement of the housing 30 relative to the base 12 through a complete stroke cycle is guided and limited by a plurality of rods 60 positioned and disposed in spaced, parallel relation to one another about an exterior of the housing 30. In a preferred embodiment, three rods 60 are used, with each extending downwardly through the cover 18 to a lower end 62 which is seated within a pocket 64 formed in the top of the base 12. Each rod 60 is received through and surrounded by a compression spring 66. An upper end 68 of each rod 60 is positioned and disposed above the cover 18 and within the confines of the corresponding compression spring 66. The upper portion of each compression spring 66 is seated within a respective pocket of a spring slide and the bottom end of each compression spring seats against the top of the base 12, surrounding the pocket 64. Thus, each compression spring 66 is vertically positioned and disposed in a partially compressed or loaded state between the spring slide 70 at the central zone 34 of the housing 30 and the top of the base 12. The top 73 of each pocket 72 of the spring slide 70 is open to permit passage of the top end 68 of the respective rods 60 therethrough upon downward movement of the housing 30. More specifically, as the housing 30 is forced downwardly through the stroke, the spring slide 70 is moved towards the top ends 68 of the rods 60, causing the compression springs 66 to become compressed. Eventually, near the bottom of the stroke, the top end 68 of each rod 60 passes through the opening 73 of the pockets 72 and engages an abutment surface 84 of a stop member 82 on a rotatable tee height selector member 80. When the top end 68 of each rod 60 engages the respective stop member 82 of the tee height selector 80, further downward movement of the housing 30 is prevented, thereby defining a bottom of the stroke.

The tee height selector 80 includes three sets 86, 87 and 88 of stop members, one set for each rod 60. In a preferred embodiment, three stop members 82, 82' and 82" are provided in each set, wherein each of the three stop members is of a different height relative to the top opening in the spring pockets, thereby providing for three different adjusted stroke distances. More specifically, referring to FIGS. 6–9, the tee height selector 80 is shown, including each of the stop members 82, 82' and 82" for each set 86, 87 and 88.

Figure 7:
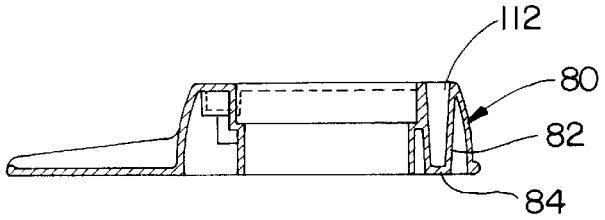
FIG. 7 is a sectional view taken along the line 7—7 of FIG. 6.
Figure 8:
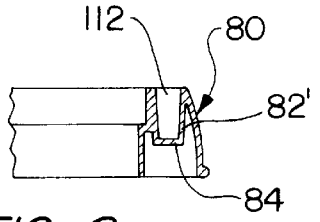
FIG. 8 is an isolated sectional view taken along the plane of line 8—8 of FIG. 6.

Referring to FIG. 7, it can be seen that a first stop member 82 extends to and is flush with a bottom of the tee height selector 80, so that the first stop member 82 is positioned just above the top hole 73 of the spring pocket 72, when aligned therewith. A next selected tee height position can be seen with reference to FIG. 8, wherein it is seen that a second stop member 82' in the set is positioned at a higher level than the first stop member 82. Thus, when the second stop member 82' in each of the three sets is axially aligned with the respective opening 73 of the spring pocket 72, above each of the rods 60, the top end 68 of the rod 60 is permitted to move through the top opening 73 of the spring pocket 72 and beyond a bottom of the tee height selector 80 until the top end 68 of the rod 60 engages the abutment surface 84 of the second stop member 82'. It can, therefore, be appreciated that the rod 60 is able to travel further upward relative to the housing 30, spring slide 70 and tee height selector 80 when the second stop member 82' is positioned above the spring pocket 72, as compared to when the first stop member 82' is positioned above the spring pocket 72. Thus, selecting the second stop member 82' position will allow the housing 30 to travel further downwardly, thereby increasing the stroke distance.

Figure 9:
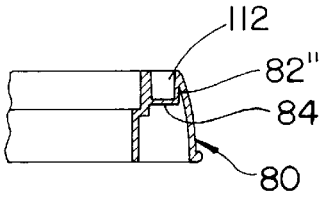
FIG. 9 is an isolated sectional view taken along the plane of line 9—9 of FIG. 6.

Finally, with reference to FIG. 9, it can be seen that a third stop member 82" in each set is positioned at even a higher level than the first 82 and second 82' stop members. It, therefore, can be appreciated that when the third stop member 82" in each set 86, 87 and 88 is positioned in axial alignment above each respective spring pocket 72, the top end 68 of the rod 60 is able to travel even further before being stopped, thus providing for the longest stroke distance of the three selected positions.

Figure 6:
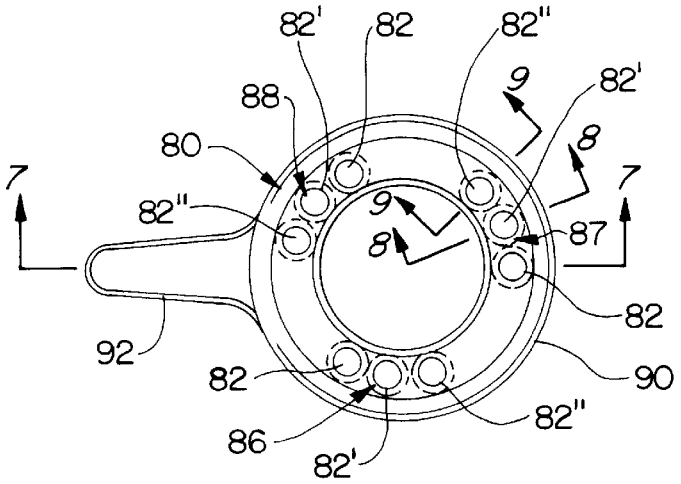
FIG. 6 is a top plan view of a tee height selector member rotatably fitted about a central zone of an elongate housing of the device.

Referring to FIGS. 1 and 6, the tee height selector 80 is shown to include a ring portion 90 which surrounds the housing 30 and an extended handle 92 to facilitate turning of the tee height selector 80 about the housing 30 to one of three adjusted positions. The three sets 86, 87 and 88 of stop members, as seen in FIG. 6, are provided about the ring. Rotating the tee height selector 80, using the handle 92, facilitates selective alignment of one of the three stop members 82, 82' or 82", in each set, with the top opening 73 of the respective pockets 72, in axial alignment with the rods 60.

In addition to returning the housing 30 to the top of the stroke, at the normally relaxed or rest position between each downward stroke, the compression springs 66 serve to urge the spring slide 70 upwardly against the tee height selector 80 which is, in turn, urged upwardly against a lock collar 100 fixed about the mid zone 34 of the housing 30. In a preferred embodiment, the lock collar 100 includes two halves which fit together about an exterior of the housing. The inner facing edges 102 of the lock collar halves are received within grooves 104 provided about the exterior 35 of the housing 30, so that the lock collar 100 is unable to move upwardly or downwardly relative to the housing 30, once secured thereto. Additionally, the inner edges 102 of the lock collar 100 are multi-sided for congruent, mating engagement with the multi-sided configuration of the housing exterior 35, thereby preventing rotation of the lock collar 100 about the housing 30. Conventional fasteners 105, such as stainless steel screws or bolts, are received through the sides of the lock collar 100 and into an axial aligned boss 106 provided on the side wall 31 of the housing 30. This serves to fixedly secure the two halves of the lock collar 100 to the housing 30, providing a means for captivating the spring slide 70 and tee height selector 80 on the housing, between the compression springs 66 and the lock collar 100. In order to releasably engage the tee height selector 80 into each of the three adjusted positions, as described above, the bottom side of the lock collar 100 is provided with three bumps 110 or protrusions, at spaced, radial intervals for releasable, interlocking receipt within an opening 112 (see FIGS. 7–9) above each of the respective stop members 82, 82' and 82". Thus, as the user rotates the tee height selector 80, using the handle 92, the user can feel the protrusions 110 entering each of the openings 112 above the respective stop members 82, 82' and 82", to thereby ensure that the selected stop member is properly aligned above the associated spring pocket 72 of the spring slide 70. Position indicators may be provided on the outer facing surface of the lock collar 100 or spring slide 70 for alignment with an arrow or indicator on the tee height selector 80, thereby enabling visual identification of the selected stop member 82, 82' or 82" (i.e., the selected stroke distance).

Movement of the elongate housing 30 through the stroke (as indicated by the arrows in FIG. 1), from the top of the stroke to the bottom of the stroke, serves to operate the device 10 in order to systematically deliver a tee 120 from the hopper 16 to a position below the lowermost ball A and to further drive the tee 120, with the ball A thereon, into the ground, to thereby tee-up the ball A. More specifically, movement of the housing 30 through the stroke operates a means for delivering individual ones of the plurality of tees 129 from the hopper 16 to a loaded position in upright axial alignment with the vertical longitudinal axis 44 below a lowermost one of the balls A in the silo 40. Downward movement of the housing 30 through the stroke further operates a timing means 130 for individually releasing the lowermost golf ball A from the bottom distal end 42 of the silo 40 and onto the axially aligned, loaded tee 120' positioned below the silo 40. As described more fully hereinafter, the timing means 130 also moves each of the balls B, C, D, etc. downwardly in the silo 40 as the housing 30 returns to the top of the stroke, so that the next successive lowermost ball B will be in position for release onto a tee during a subsequent downward stroke.

Figure 3:
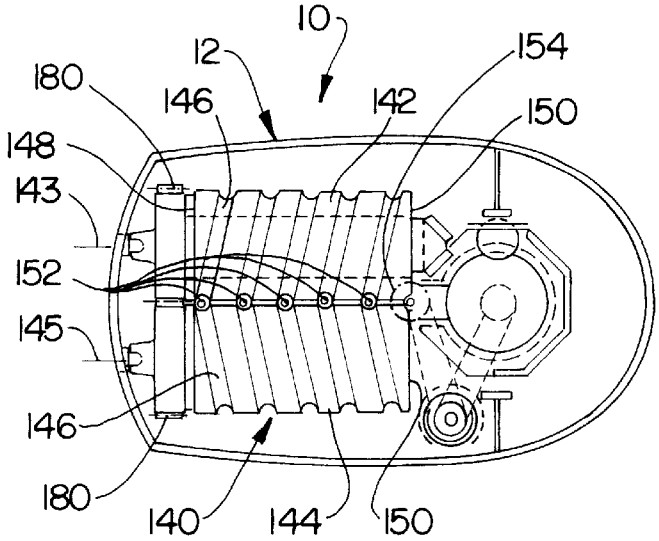
FIG. 3 is a top plan view taken along the plane 3—3 of FIG. 1.

The means for delivering the individual tees 120 from the hopper 16 to the loaded position includes a feed roller assembly 140, positioned below the hopper 16, and a tee pick-up arm 200 for carrying the individual tees 120 from the feed roller assembly 140 to the loaded position in axial alignment with the longitudinal axis 44, below the lowermost ball A in the silo 40. Referring to FIGS. 1 and 3, the feed roller assembly 140 includes a pair of cylindrical rollers 142, 144 positioned side by side so that their rotational axes 143, 145 are parallel. The outer cylindrical walls of each roller is provided with a spiraling groove 146 beginning an outboard end 148 of each of the rollers 142 and terminating at an inboard end 150 of each roller. The rollers 142, 144 are initially set into place so that the positioning of the spiraling grooves 146 of the rollers 142, 144 coincide, meeting along the adjacently positioned sides of the rollers to thereby define generally circular passages 152 at spaced intervals along the center feed line 154 extending longitudinally between the adjacently positioned rollers 142, 144. The rollers 142, 144 are specifically structured to rotate in opposing directions (i.e., left rotation and right rotation) so that the spiraling grooves 146 remain in coinciding alignment as the rollers 142, 144 rotate. This results in the formed through-holes or circular passages 152 moving towards the inboard end 150 of the feed roller assembly 140, along the feed line 154, as the feed rollers 142, 144 rotate. More specifically, the spiraling groove 146 in the one feed roller 142 is cut in a first direction, defining a left hand screw, while the spiraling groove 146 in the opposing feed roller 144 is cut in the opposite direction, defining a right hand screw. In this manner, the counter rotation of the rollers 142, 144 serves to maintain the coinciding alignment of the left and right handed spiraling grooves 146. In order to rotate the feed rollers 142, 144, a bevel gear 160 is fitted axially within one roller so that a bevel gear face 162 protrudes outwardly from the inboard end 150 of the roller. In the preferred embodiment, shown in FIGS. 1 and 3, the bevel gear 160 is fitted to the left hand roller 142. The bevel gear face 162 is specifically positioned and disposed in driven engagement with a rack gear face 170 formed on the outer surface 35 of the lower end zone 32 of the elongate housing 30. Thus, upon downward movement of the housing 30 through the stroke, the rack gear 170 is moved relative to the bevel gear face 162, thereby drivingly rotating the bevel gear 160 and feed roller 142 which is fixed to the bevel gear 160 with the use of a central axle 172. As seen in FIG. 1, the central axle 172 extends axially through a clutch 174 and into fitted receipt within the outboard end portion 148 of the feed roller 142. The clutch 174, in turn, is fixed to the bevel gear 160 with the use of a sleeve 176. Accordingly, as the bevel gear 160 is rotated during the downward stroke, the rotational force is transferred through the clutch 174 and to the central axle 172 which thereby rotationally drives the feed roller 142. Furthermore, the outboard end portion 148 of each feed roller 142, 144 is provided with an annular gear face 180 on the outer cylindrical surface. The annular gear faces 180 on the feed rollers 142, 144 intermesh so that driven rotation of the left hand feed roller 142 serves to drivingly rotate the right hand feed roller 144, in the opposite rotational direction.

As the left and right hand feed rollers 142, 144 are rotated, tees resting on top of the rollers eventually find their way into the through-holes 152 formed between the spiraling grooves 146 of the opposing feed rollers 142, 144. With each downward stroke, the tee 120 is advanced along the feed line 154 to the inboard end 150 of the feed roller assembly 140. Upon return of the housing to the top of the stroke, the clutch 174 disengages the central axle 172, thereby preventing reverse rotation of the feed roller assembly 140. Thus, as the rack gear 170 moves upwardly, drivingly rotating the bevel gear 160 in the opposite direction, the clutch 174 slips relative to the central axle 172, so that the central axle 172 does not rotate. With each downward stroke, the tees 120 are moved one position along the feed line 154, represented by the distance between each of the through-holes 152 seen from the top plan view of FIG. 3.

Figure 5:
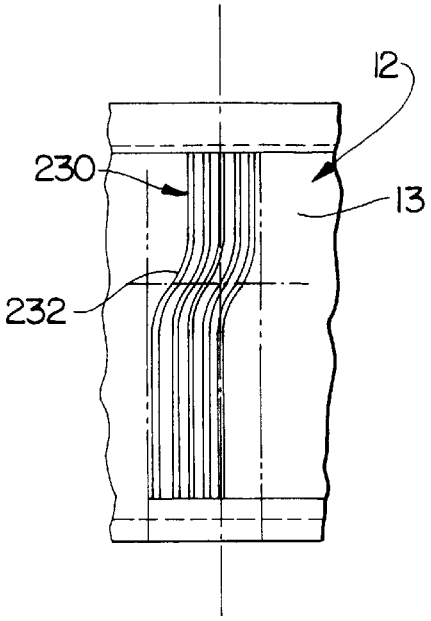
FIG. 5 is an isolated view taken from the area 5 in FIG. 2, showing a cam track on an inner wall surface of the base for driven engagement with a gear segment of a pick-up arm shown in FIG. 4.
Figure 4:
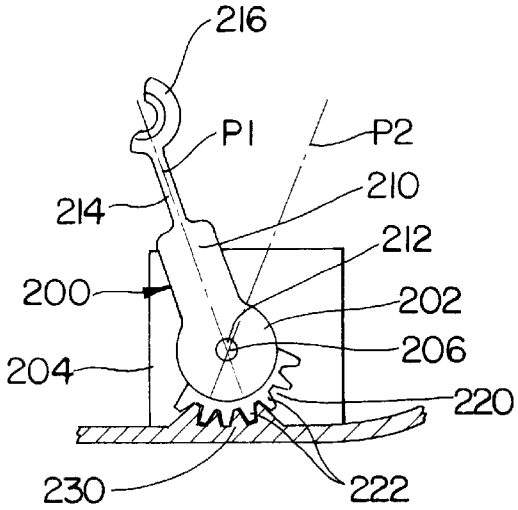
FIG. 4 is an isolated top plan view, in partial section, taken from the section 4—4 of FIG. 2.

Simultaneous with the operation of the feed roller assembly 140, the tee pick-up arm 200 is operated to grasp a tee 120 at the inboard end 150 of the feed roller assembly 140 and to move the tee into the loaded position along the longitudinal central axis 44 of the silo 40. With reference to FIGS. 3, 4 and 5, the pick-up arm 200 is shown to include a generally circular base portion 202 which is rotatably fitted to a flange 204 extending from the lower end zone 32 of the housing 30, with the use of a dowel or pivot pin 206. Extending from the circular base 202, the pick-up arm 200 includes a first portion 210 which extends radially out from the central rotational axis 212. A second, smaller arm portion 214 extends from the first portion 210 to a generally C-shaped grasping member 216. The second portion 214 of the arm 200 is of a reduced thickness in order to provide sufficient flexibility. The C-shaped grasping portion 216 is specifically sized and configured for snap-fit engagement with the top annular shoulder of the tee 120 so that the tee can be carried securely and in an upright position from the feed roller assembly 140 to the loaded position below the silo 40. In a preferred embodiment, the C-shaped grasping member 216 is provided with an undercut inner face which is specifically sized and configured for snap-fit engagement with the top annular shoulder of the golf tee.

The circular base 202 of the pick-up arm 200 is further provided with a gear segment 220 which includes a plurality of gear teeth 222 positioned and disposed for driven engagement within a longitudinal cam track 230 formed along the inner surface 13 of the wall of the base 12, as seen in FIG. 5. A portion 232 of the longitudinal cam track 230 is skewed to thereby impart a rotational force to the gear segment 220 on the pick-up arm 200 as the gear teeth 222 move downwardly along the cam track 230. This serves to move the pick-up arm 200 from a first position, wherein the C-shaped grasping member 216 is maintained adjacent the inboard end 150 of the feed roller assembly 140, as seen in FIGS. 3 and 4, to a second position, wherein the C-shaped grasping portion 216 is positioned in axial alignment with the longitudinal axis 44 of the silo 40. Thus, it can be appreciated that movement of the gear segment 220 along the cam track 230, during the downward stroke, serves to move the pick-up arm 200 from the first position to the second position, with a tee 120' held within the grasping member 216. Once in the loaded position (see FIGS. 10B and 10C), with the tee 120' in axial alignment along the longitudinal axis 44, a lowermost ball A is released onto the top of the tee 120'. Then, upon return of the housing 30 from the bottom of the stroke to the top of the stroke, the gear segment 220 moves upwardly along the cam track 230 whereupon travel through the skewed section 232 of the cam track 230 serves to move the pick-up arm 200 back to the first position, for grasping a next successive tee delivered to the inboard end 150 of the feed roller assembly 140.

In order to control movement of the balls A–D, etc., downwardly through the silo 40, and release of the lowermost ball A onto the loaded tee 120', the timing means 130 is operated through the stroke cycle. Specifically, the timing means 130 includes a plurality of timing balls 131, 132, 133, each movably disposed and captivated within a respective socket 134 formed in the wall structure 31 of the elongate housing 30. In a preferred embodiment, three timing balls 131, 132, 133 are used, each being captivated within a respective socket 134 on the housing 30. Each socket 134 is opened at both ends to permit the timing balls 131, 132, 133 to protrude partially therefrom. The inner facing sides of the sockets include an opening 135 which is of a smaller diameter than the diameter of the respective timing ball 131, 132 or 133, thereby preventing the timing balls from exiting the sockets 134 and falling into the silo 40. The timing balls are further captivated by the inner wall surface 33 of the base, which prevents the timing balls falling outwardly from the sockets, away from the housing. The inner wall surface 13 of the base 12 is further provided with shoulders 136 at strategic positions to thereby engage the timing balls 131, 132 and 133 and force the timing balls inwardly, during movement of the housing 30 through the stroke, so that a portion of the timing balls is forced through the opening 135 of the socket 134 and into the silo 40. Upon clearing the shoulders 136, the timing balls 131, 132 and 133 are able to fall back into the sockets 134, to a relaxed state, so that the timing balls remain clear of the silo 40.

Figure 10C:
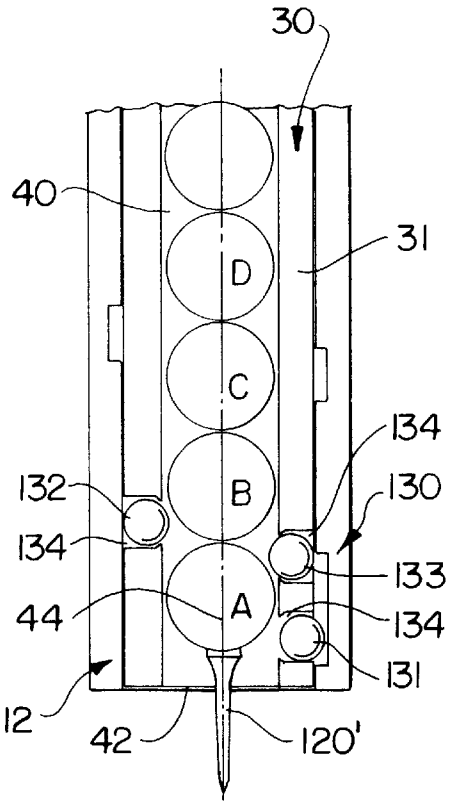
FIGS. 10A–10C illustrate a sequence of operation of a timing ball assembly upon movement of the housing through a downward stroke, to thereby control movement and release of the golf balls contained within a silo of the housing.
Figure 10B:
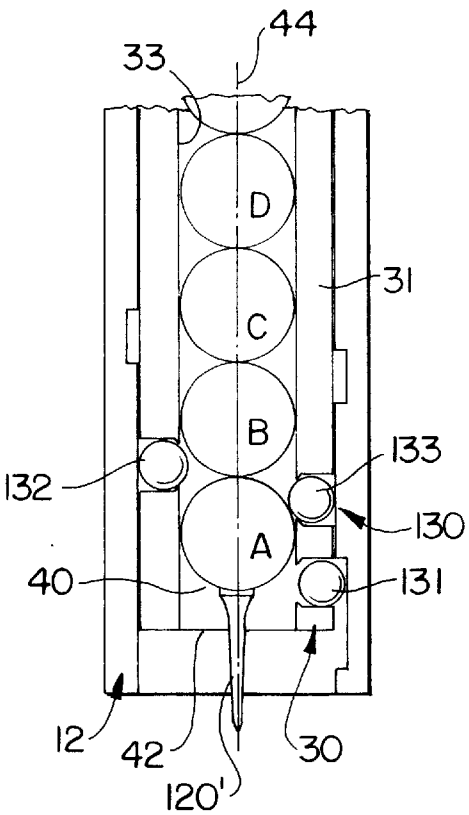
Figure 10A:
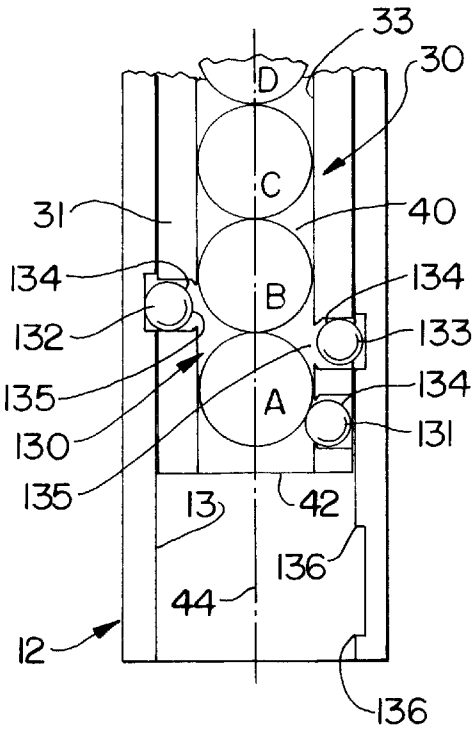

Referring to FIGS. 10A–10C, a sequence of operation of the timing assembly 130 is shown from the top of the stroke to the bottom of the stroke. Referring initially to FIG. 10A, at the top of the stroke, timing ball 131 is urged inwardly, so that it projects into the silo 40 and into engagement with an under side portion of the lowermost ball A, thereby holding the ball A in position and preventing the balls A–D, etc., from falling completely through the ball silo 40 when the device 10 is at rest. This further permits loading of additional balls into the silo 40. The first golf ball (i.e., the lowermost golf ball) A to drop through the silo 40 is stopped timing ball 131 and in sequence, golf balls B, C, D, etc. follow in line, along the longitudinal axis, to the top.

In order to enable movement of a tee 120' into the loaded position for the lowermost golf ball A to be placed on, it is necessary to hold back the golf balls A–D, etc., during the initial portion of the stroke. Once a tee 120' is in a loaded position, the lowermost golf ball A can be released from the lower distal end 42 of the silo 40. However, it is important to hold back the remaining golf balls B, C, D, etc. so that they don't interfere with placement of the lowermost ball A on the tee 120'. Thus, as the housing 30 is moved downwardly in the stroke, the timing ball 132 is urged outwardly into engagement with ball B, thereby holding balls B, C, D, etc. in fixed position within the silo 40. At the same time, timing ball 133 is urged outwardly to engage an upper portion of lowermost ball A, so that ball A does not interfere with remaining balls B, C, D, etc. once released onto the tee 120'. Timing ball 133 further applies pressure to the top of ball A, one ball A is on the tee 120', so that upon continued movement through the downward stroke, pressure exerted by timing ball 133 onto ball A serves to drive the tee 120' into the ground. More specifically, upward movement of ball A is prevented as downward thrust of the housing and silo 40 is continued through to the lower portion of the stroke. Depending upon the selected stroke distance, using the tee height selector 80 as described above, the tee 120' will be driven into the ground at one of three selected heights. At the bottom of the stroke, downward hand pressure on the handle 46 is released, and the housing 30 returns upwardly, by spring action, enabling the device 10 for the next stroke cycle. During upward movement of the housing 30, from the bottom of the stroke to the top of the stroke, timing balls 132 and 133 return to a concealed, retracted position, while timing ball 131 is urged outwardly, to block the next successive lowermost ball B in the silo, thereby holding all of the balls in place, in the position shown in FIG. 10A, so that they do not fall out of the bottom end 42 of the silo 40.

While the instant invention has been shown and described in accordance with a preferred and practical embodiment thereof, it is recognized that departures may be made from the instant disclosure which, therefore, should not be limited except as set forth in the following claims as interpreted under the doctrine of equivalents.

What is claimed is:

1. A golf ball tee-up device comprising:

a base;

a housing extending upwardly from the base and including a chamber for holding a plurality of golf balls therein;

means for holding a plurality of golf tees;

means for moving individual ones of said plurality of tees into a loaded position;

means for releasing an individual one of said plurality of golf balls onto said tee in said loaded position; and means for driving the tee, with the golf ball supported thereon, into the ground, so that the golf ball is supported on the tee in spaced relation above the ground.

2. The device as recited in claim 1 wherein said means for holding a plurality of golf tees includes a hopper in said base.

3. The device as recited in claim 2 wherein said means for moving individual ones of said plurality of tees comprises:

a feed roller assembly including a pair of adjacently positioned feed rollers, said feed roller assembly being structured for moving said individual ones of said plurality of tees along a feed line defined between said pair of feed rollers;

a pickup arm assembly for moving said individual ones of said plurality of tees from said feed roller assembly to said loaded position; and said feed roller assembly being structured to deliver said individual ones of said plurality of tees along said feed line to said pickup arm assembly.

4. The device as recited in claim 3 wherein said housing includes an elongate body movably fitted to said base and being movable relative to said base through a range of vertical movement defining a stroke, between a first relaxed position and a second position.

5. The device as recited in claim 4 further including means for operating said feed roller assembly and said pickup arm assembly during downward movement of said elongate body through said stroke to thereby deliver one of said plurality of tees to said loaded position upon movement of said elongate body from said first position to said second position.

6. The device as recited in claim 5 further comprising:

stop means for stopping movement of said elongate body at a bottom of said stroke, defining said second position; and stroke adjustment means for adjusting said range of movement of said elongate body through said stroke, between said first position and said second position.

7. The device as recited in claim 6 further comprising:

biasing means for urging said elongate body from said second position to said first position.

8. The device as recited in claim 7 further comprising:

timing means for individually releasing said individual one of said plurality of golf balls onto said tee in said loaded position during said stroke while maintaining a remainder of said plurality of golf balls within said chamber.

9. The device as recited in claim 8 further comprising:

handle means on said elongate body for applying a downward force, against said biasing means, to thereby operatively move said elongate body from said first position to said stop position.

10. A device for placing a golf ball on a tee comprising:

a base including a ground engaging portion;

a housing movably fitted to said base and being movable relative to said base through a range of movement, between a first position and a second position, thereby defining a stroke;

means for holding the golf ball within said housing;

means for moving the tee to a loaded position for receipt of the golf ball thereon during a first portion of said stroke;

means for releasing the golf ball from said housing and onto the tee during a second portion of said stroke; and means for driving the tee with the golf ball supported thereon, into the ground, so that the golf ball is supported on the tee in spaced relation above the ground.

11. The device as recited in claim 10 wherein said housing includes a chamber for holding a plurality of golf balls therein.

12. The device as recited in claim 11 wherein said base includes a hopper for holding a plurality of golf tees.

13. The device as recited in claim 12 further comprising:

stroke adjustment means for adjusting said range of movement of said housing through said stroke, between said first position and said second position.

14. The device as recited in claim 13 further comprising:

biasing means for urging said housing from said second position to said first position.

15. The device as recited in claim 14 wherein said means for moving the tee further comprises:

means for delivering individual ones of said plurality of tees from said hopper to said loaded position for receipt of the golf ball thereon.

16. The device as recited in claim 15 further comprising:

timing means for individually releasing one of said plurality of golf balls from said chamber and onto the tee.

17. The device as recited in claim 16 wherein said means for driving further comprises:

means for applying a downward force on the golf ball supported on the tee, to thereby drive the tee into the ground with the golf ball positioned and held thereon.

18. A golf ball tee-up device comprising:

a base including a ground engaging portion surrounding an open bottom, a hopper for holding a plurality of golf tees, and a vertical channel extending through a top of said base and communicating with said open bottom;

an elongate body movably fitted to said base and including a multi-sided wall structure surrounding an elongate chamber defining a ball silo, said ball silo being structured and disposed for containing a plurality of golf balls in a vertically aligned array along a vertical longitudinal axis extending through said ball silo, and said elongate body being movable relative to said base through a range of vertical movement defining a stroke, between a first relaxed position and a second stopped position;

said elongate body further including:

a lower end zone slidably received and captivated within said vertical channel of said base;

a central zone normally spaced above said base; and an upper zone including means for depositing golf balls into said ball silo and handle means for applying a downward force to said elongate body to move said body through said stroke from said first position to said second position;

stop means for stopping movement of said elongate body at a bottom of said stroke, defining said second position and including stroke adjustment means for adjusting said range of movement of said elongate body through said stroke, between said first position and said second position;

biasing means for urging said elongate body from said second position to said first position;

means for delivering individual ones of said plurality of tees from said hopper to a loaded position in upright axial alignment with said vertical longitudinal axis below a lowermost one of said plurality of golf balls in said ball silo upon downward movement of said elongate body from said first position towards said second position;

timing means for individually releasing said lowermost golf ball from said distal end of said silo and onto said axially aligned tee there below, and said timing means including pressure application means for applying a downward force on said golf ball and said axially aligned tee to thereby drive said tee into the ground with said golf ball positioned and held thereon, as said stroke is continued through to said second position; and said timing means being further structured to move said plurality of golf balls downwardly in said ball silo upon said biasing means urging said elongate body towards said first position to thereby move a next successive lowermost golf ball in said silo into position for subsequent release from said distal end of said ball silo during a next successive stroke.

* * * * *